US011191308B2

(12) United States Patent
Gonsalves et al.

(10) Patent No.: US 11,191,308 B2
(45) Date of Patent: Dec. 7, 2021

(54) MOTORCYCLING APPAREL

(71) Applicants: Austin W. Gonsalves, Grand Junction, CO (US); Spencer T. Lee, Grand Junction, CO (US)

(72) Inventors: Austin W. Gonsalves, Grand Junction, CO (US); Spencer T. Lee, Grand Junction, CO (US)

(73) Assignee: Sofa Brand, LLC, Denver, CO (US)

( * ) Notice: Subject to any disclaimer, the term of this patent is extended or adjusted under 35 U.S.C. 154(b) by 141 days.

(21) Appl. No.: 16/296,011

(22) Filed: Mar. 7, 2019

(65) Prior Publication Data

US 2019/0320736 A1 Oct. 24, 2019

Related U.S. Application Data

(60) Provisional application No. 62/659,139, filed on Apr. 18, 2018.

(51) Int. Cl.

| | |
|---|---|
| ***A41D 1/084*** | (2018.01) |
| ***A41D 13/05*** | (2006.01) |
| ***A41D 1/08*** | (2018.01) |
| ***A63B 71/08*** | (2006.01) |

(52) U.S. Cl.

CPC ..... *A41D 1/084* (2013.01); *A41D 1/088* (2013.01); *A41D 13/05* (2013.01); *A41D 2600/102* (2013.01); *A63B 71/08* (2013.01)

(58) Field of Classification Search

CPC ..... A41D 1/08; A41D 1/084; A41D 1/088; A41D 13/05; A41F 7/00

USPC ..... 2/79

See application file for complete search history.

(56) References Cited

U.S. PATENT DOCUMENTS

| | | | | |
|---|---|---|---|---|
| 3,127,896 A * | 4/1964 | Puliafico | A41D 1/06 | 450/95 |
| 4,843,654 A * | 7/1989 | March | A41D 1/086 | 2/227 |
| 6,041,437 A * | 3/2000 | Barker | A41D 1/067 | 156/278 |
| 6,477,716 B2 * | 11/2002 | Blaire | A41D 1/06 | 2/227 |
| 6,792,621 B2 * | 9/2004 | Braun | A41D 27/285 | 2/1 |
| 7,341,500 B2 * | 3/2008 | Horn | A41D 1/06 | 450/122 |

(Continued)

OTHER PUBLICATIONS

International Search Report and Written Opinion for International (PCT) Patent Application No. PCT/US2019/28119, dated Aug. 22, 2019, 12 pages.

(Continued)

*Primary Examiner* — Gloria M Hale

(74) *Attorney, Agent, or Firm* — Heuton IP Law, LLC

(57) ABSTRACT

Motorcycling apparel, particularly motorcycling jerseys and pants, and methods of manufacture thereof are provided. In the motorcycling pant of the invention, a compressive inner layer is integrally affixed to a protective outer layer. In embodiments, the motorcycling pant includes a zipper for securing the outer layer snugly around a leg of the wearer. The integrally affixed compressive layer and zipper mechanism permit a wearer to put on additional protective gear, e.g. knee braces, over the motorcycling pant with less time and effort than previous motorcycling pants require.

10 Claims, 3 Drawing Sheets

(56) References Cited

U.S. PATENT DOCUMENTS 7,832,022 B1 * 11/2010 Peters ..... A41D 1/084 2/227
7,849,522 B2 * 12/2010 Roux ..... A41D 1/089 2/227
7,950,070 B2 * 5/2011 Beven ..... A41B 9/026 2/235
8,850,619 B2 * 10/2014 Rush ..... A41D 1/089 2/228
9,968,139 B2 * 5/2018 Callahan ..... A41C 1/08
2003/0024028 A1 * 2/2003 Sleesen ..... A41D 13/0158 2/2.17
2007/0169250 A1 * 7/2007 Maniguet ..... A41D 13/065 2/227
2008/0034476 A1 * 2/2008 MacKinnon ..... A41B 11/003 2/228
2010/0167626 A1 * 7/2010 Hamlet ..... A41C 1/003 450/95
2010/0199399 A1 * 8/2010 Garza ..... A41D 15/002 2/24
2012/0129425 A1 * 5/2012 Bevans ..... A41D 1/14 450/11
2013/0095730 A1 * 4/2013 Jensen ..... A41C 1/003 450/95
2013/0298311 A1 * 11/2013 Gerenda ..... A41F 9/025 2/235
2016/0058085 A1 * 3/2016 Reddic ..... A41D 1/089 2/84
2016/0213071 A1 * 7/2016 Vornle von Haagenfels ..... A41D 1/08

OTHER PUBLICATIONS

Invitation to Pay Additional Fees for International (PCT) Patent Application No. PCT/US2019/28119, dated Jun. 28, 2019, 2 pages.

* cited by examiner

MOTORCYCLING APPAREL

CROSS-REFERENCE TO RELATED APPLICATION

This application claims the benefit under 35 U.S.C. § 119(e) of U.S. Provisional Patent Application 62/659,139, filed 18 Apr. 2018, the entirety of which is incorporated herein by reference.

FIELD OF THE INVENTION

This application relates generally to motorcycling apparel, and more specifically to high-performance apparel, including but not limited to jerseys and pants, adapted for use in motocross racing and similar applications.

BACKGROUND OF THE INVENTION

Previous generations of motocross and other motorcycling apparel have suffered from significant drawbacks regarding performance, wearer comfort, and ease of use. For example, most currently available motocross pants utilize inflexible materials such as Kevlar throughout an entire length of the pant leg and thus provide for a loose fit around the bottom portion of the wearer's leg; because motocross boots are configured to be fastened to at least as high as a midpoint of the wearer's calf, the loose-fitting leg of the pant may bunch and wrinkle underneath the boot, causing irritation to the skin and a general loss of comfort for the wearer. Furthermore, the inks and dyes used to incorporate designs into the garments may heat up, and in some cases at least partially liquefy, when exposed to heat, which can be uncomfortable or even dangerous to the wearer.

Similar problems may be encountered whenever and wherever the motocross pant or other garment is disposed between the wearer's body and the motorcycle or another object. Loose-fitting fabrics of motocross garments may be caught on parts of the motorcycle or cause irritation to the wearer when the wearer, for example, moves from a standing position to a sitting position or changes his or her position on the motorcycle seat (both of which occur frequently in many motorcycling applications, especially motocross).

The currently available mechanisms for adjusting, enclosing, fastening, and/or tightening motocross and other motorcycling apparel also leave much to be desired. For example, one commonly provided system for adjusting a motocross pant comprises a zipper and a belt utilizing a clip- or cable tie-type mechanism. The zippers of such systems are generally bulky and inflexible, fail to conform to movements of the wearer's body, and may catch or become entangled with a portion of a jersey that is tucked into the pant. The belt having a clip- or cable tie-type mechanism generally offers little in the way of adjustability (often permitting, e.g., a waist of a pant to be loosened or tightened by only a few inches), and is usually made of lightweight plastic or other materials that may break, crack, or otherwise fail under conditions commonly encountered during motorcycling (e.g. impact from a rock or other object, vibrations of the motorcycle body due to the engine or rough terrain, etc.).

Also problematic is the lack of protective, comfort-improving, and/or performance-improving elements disposed on interior (wearer-facing) surfaces of motocross jerseys and pants and other motorcycling garments. For example, the inside of a motocross pant will generally be made entirely or nearly entirely of the same inflexible materials as the exterior of the pant; in many cases, the only element added for the protection and/or comfort of the wearer is a mesh lining, generally adapted to surround at least a part of the wearer's pelvic region (i.e. much like the mesh linings of men's swimming trunks). Such mesh linings and other similar features are generally rough and irritating after prolonged use, and in any event rarely provide more than minimal protection or comfort to the wearer. Additionally, the breathability of these garments—an important consideration, given the hot conditions prevalent in many motorcycling applications—is typically very poor, as manufacturers are generally unwilling to provide materials that both improve the comfort of the wearer and protect the wearer in case of collision or other accident.

There is thus a need in the art for improved motorcycling apparel, and particularly garments for use in motocross that provide the wearer with improved comfort and ease of use while maintaining a high degree of protection against heat, impacts, vibration, and other hazards commonly encountered in motorcycling.

SUMMARY OF THE INVENTION

It is one aspect of the present invention to provide a motorcycling pant, comprising an outer layer, comprising a zipper disposed on a posterior surface of a leg portion of the outer layer; and an inner layer, comprising a compressive garment, wherein the compressive garment of the inner layer is integrally affixed to an inner surface of the outer layer.

In embodiments, the compressive garment of the inner layer may be integrally affixed to the inner surface of the outer layer by sewing or stitching.

In embodiments, the compressive garment of the inner layer may be integrally affixed to the inner surface of the outer layer by heat-sealing.

In embodiments, the zipper may be oriented substantially vertically along a length of the leg portion of the outer layer. The zipper may, but need not, have a lower terminus coincident with a cuff of the leg portion of the outer layer and an upper terminus located approximately midway between a knee of the outer layer and a waist of the outer layer.

In embodiments, the zipper may be oriented substantially horizontally across a width of the leg portion of the outer layer.

In embodiments, the motorcycling pant may further comprise a lacing fly closure.

In embodiments, the motorcycling pant may further comprise a double-loop tightening device.

In embodiments, the motorcycling pant may further comprise a knee protection element disposed on a lateral knee portion of an outer layer.

It is another aspect of the present invention to provide a motorcycling jersey, comprising a ventilation system, comprising a segment of a breathable material disposed on an axillary portion of the motorcycling jersey; and an elongated tail, adapted to extend below at least a portion of buttocks of a wearer of the motorcycling jersey.

In embodiments, at least one sleeve of the motorcycling jersey may comprise an elastic material and is adapted to provide a compressive effect to an arm of the wearer.

In embodiments, at least one sleeve of the motorcycling jersey may comprise a moisture-wicking material.

In embodiments, the breathable material of the ventilation system may comprise a mesh material.

In embodiments, the ventilation system may be at least partially disposed on a posterior surface of the axillary portion of the motorcycling jersey.

In embodiments, the motorcycling jersey may further comprise an elongate vent extending along at least part of a length of a sleeve of the motorcycling jersey. The elongate vent may, but need not, have a proximal end coincident with the ventilation system. The elongate vent may, but need not, be disposed on a posterior surface of the sleeve of the motorcycling jersey. The elongate vent may, but need not, comprise a mesh material.

It is another aspect of the present invention to provide a method for manufacturing a motorcycling pant, comprising providing a compressive garment; disposing the compressive garment within a motorcycling pant outer layer; integrally affixing the compressive garment to an inner surface of the outer layer; and installing a zipper on a posterior surface of a leg portion of the outer layer.

In embodiments, the integrally affixing step may comprise sewing or stitching the compressive garment to the inner surface of the outer layer.

In the appended figures, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label.

DETAILED DESCRIPTION OF THE INVENTION

In the following description, for the purposes of explanation, numerous specific details are set forth in order to provide a thorough understanding of various embodiments disclosed herein. It will be apparent, however, to one skilled in the art that various embodiments of the present disclosure may be practiced without some of these specific details. The ensuing description provides exemplary embodiments only, and is not intended to limit the scope or applicability of the disclosure. Furthermore, to avoid unnecessarily obscuring the present disclosure, the preceding description omits a number of known structures and devices. This omission is not to be construed as a limitation of the scopes of the claims. Rather, the ensuing description of the exemplary embodiments will provide those skilled in the art with an enabling description for implementing an exemplary embodiment. It should however be appreciated that the present disclosure may be practiced in a variety of ways beyond the specific detail set forth herein.

As used herein, the phrases "at least one," "one or more," "or," and "and/or" are open-ended expressions that are both conjunctive and disjunctive in operation. For example, each of the expressions "at least one of A, B and C," "at least one of A, B, or C," "one or more of A, B, and C," "one or more of A, B, or C," "A, B, and/or C," and "A, B, or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

Figure 1B:
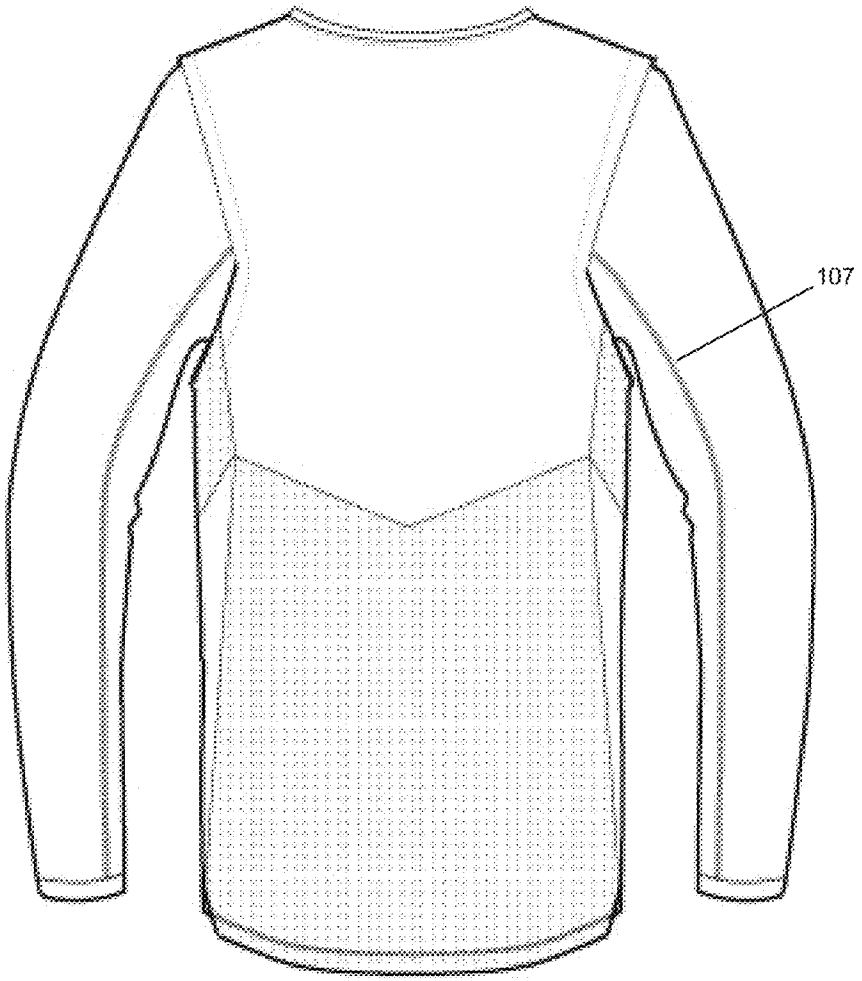
FIGS. 1A and 1B are views of an anterior portion and a posterior portion, respectively, of a motorcycling jersey, according to embodiments of the present invention.
Figure 1A:
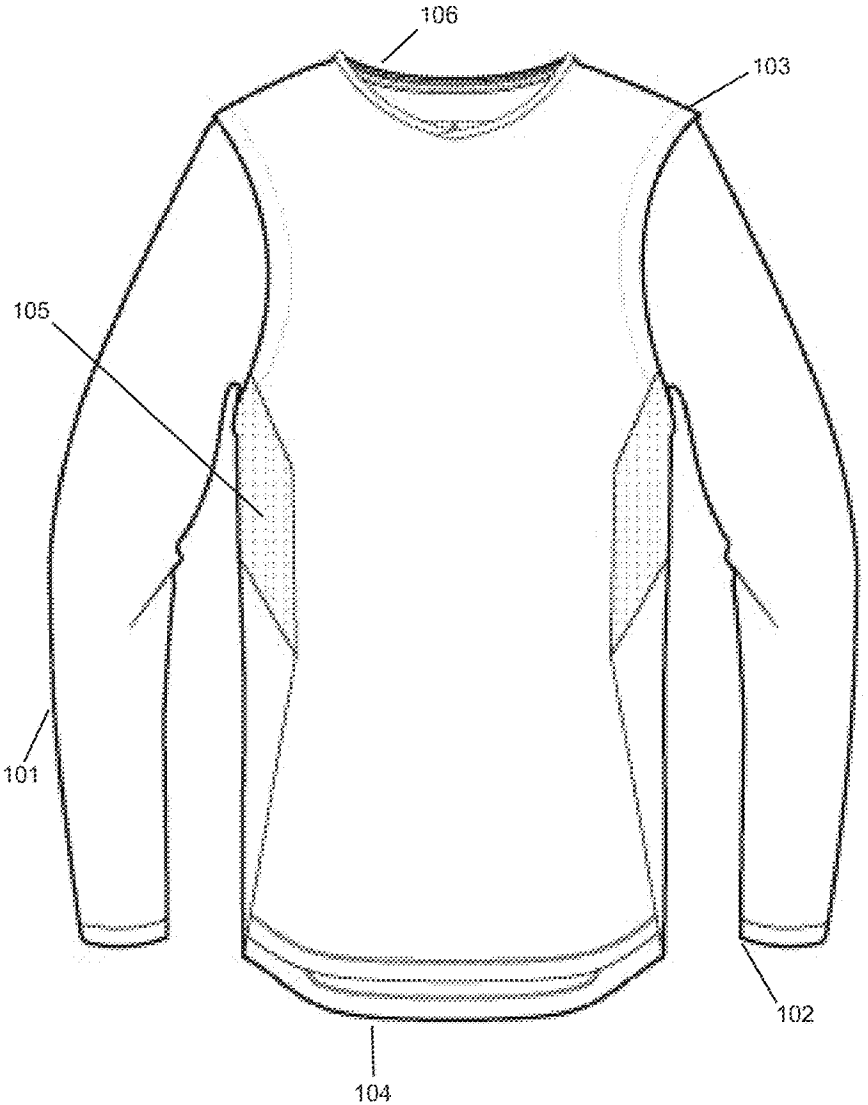

Referring now to FIGS. 1A and 1B, a motorcycling jersey 100 according to embodiments of the present invention is illustrated. In this embodiment, the motorcycling jersey 100 comprises a sleeve 101 having a cuff 102 at a distal end and secured to the torso of the jersey via a seam 103, a tail 104, a ventilation system 105, a collar 106, and a vent 107.

Unlike prior art motorcycling jerseys, which are generally loose-fitting and may therefore cause chafing when moved across the skin of the wearer by wind resistance or impact forces, motorcycling jerseys 100 according to the present invention are preferably characterized by a "slim fit" that conforms relatively closely to the body of the wearer, as illustrated in FIGS. 1A and 1B. Such a "slim fit" design reduces wind turbulence and therefore chafing, and provides greater support to the upper body of the wearer, both of which improve the wearer's level of comfort.

While the embodiment of the motorcycling jersey 100 illustrated in FIGS. 1A and 1B is shown with a "V-neck" collar 106, it is to be expressly understood that motorcycling jerseys 100 having a "crew neck" collar or other type of collar 106 are within the scope of the present invention.

The ventilation system 105 of the motorcycling jersey 100 generally comprises a portion of a mesh material or other similar material that permits a significant degree of air flow through the motorcycling jersey 100. In particular, ventilation systems 104 according to the present invention provide a mesh material or other similar material in an axillary portion (i.e. on or near the wearer's armpit) of the motorcycling jersey 100; the mesh material or other similar material is preferably of a lighter weight (i.e. lower density) than the material(s) of which a remainder of the jersey is made. The presence of the ventilation system 105 is desirable for several reasons, among which is that because the axillary region (armpit) of the wearer tends to be an area of high perspiration and therefore high moisture content, greater evaporation in this region significantly mitigates the chafing suffered by the wearer while wearing the motorcycling jersey 100. Additionally, because the axillary/armpit region of the wearer is generally a low priority for protection against injuries because few motorcycling injuries occur in this region, it is possible to provide in this region a very lightweight material to cut down the total weight of the motorcycling jersey 100 without significantly affecting the protective capabilities of the motorcycling jersey 100. In embodiments in which the ventilation system 105 comprises a mesh material, it is preferable that the mesh be fine and dark-colored to limit the exposure of the wearer's skin to sunlight, which may cause sunburn.

The "slim fit" of the motorcycling jersey 100 may, in some embodiments, take the form of a compression garment-like design (similar to the compression features of motorcycling pants of the present invention, as described in greater detail below). Without wishing to be bound by any particular theory, it is believed that imparting a compressive effect to the upper body of the wearer via the motorcycling jersey 100 may improve blood flow and/or otherwise improve the wearer's physical performance while motorcycling.

The tail 104 of the motorcycling jersey 100 of the present invention provides another important benefit to the wearer. The most common malfunction of conventional and/or previously known motorcycling apparel is a tendency for the jersey to become untucked from the waistband of a motorcycling pant or similar garment while the wearer is riding the motorcycle; specifically, movement of the wearer's buttocks on the seat of a dirt bike or similar vehicle may vertically move the tail of the motorcycling jersey relative to the waistband of the motorcycling pant (or vice versa), causing the jersey to become untucked. By contrast, the elongated tail 104 of the motorcycling jersey 100 of the present invention may generally extend down to or beyond the wearer's buttocks, such that when the jersey 100 is in use and the wearer is seated on the seat of a dirt bike or similar vehicle, the tail 104 and a motorcycling pant or similar garment move together with movement of the wearer's buttocks.

Apart from the ventilation system 105, the motorcycling jersey 100 of the present invention may be made of any material or combination of materials that provides adequate protection against heat, impact, puncture, vibration, and/or other hazards commonly encountered in motorcycling. The material(s) is/are preferably thin, soft, flexible, and lightweight, so as to enhance the breathability and comfort of the motorcycling jersey 100 and thus the performance of the wearer. It is further preferable for the material(s) to allow for bright, colorful, and/or highly precise designs and/or patterns. Material(s) suitable for use in motorcycling jerseys 100 of the present invention may include, but are not limited to, nylon, modacrylic, olefin fiber, acrylic fiber, polyester, rayon (including but not limited to modal and Lyocell), spandex, vinalon, aramids (including but not limited to Nomex, Kevlar, and Twaron), Dyneema, polybenzimidazole fiber (PBI), and wool.

The cuff 102 at the distal end of the sleeve 101 of the motorcycling jersey 100 preferably comprises an elastic material and provides a snug fit around the wrist of the wearer. This is particularly advantageous for applications, such as motocross competition, in which the wearer may also wear gloves and it is desired that the jersey 100 and gloves collectively provide a continuous layer of protection along an entire length of the wearer's arm. It is further advantageous for the cuff 102 to comprise an elastic material and provide a snug fit around the wrist of the wearer when the sleeve 101 of the jersey 100 is intended to provide a compressive effect to the wearer's arms, for the reasons previously discussed.

The sleeve 101 of the motorcycling jersey 100 of the present invention preferably comprises a compressive portion or material, for the reasons previously discussed. In many embodiments, it may be further advantageous for the sleeve to comprise a moisture-wicking portion or material, which may promote transport of sweat and other fluids away from the wearer's body and assist in keeping the wearer dry and at a comfortable temperature. Such embodiments may be desirable for use in, e.g., inclement or otherwise challenging weather conditions (heavy rain or wind, very cold or very warm temperatures, etc.).

The seam 103 of the motorcycling jersey 100 of the present invention secures the sleeve 101 of the jersey 100 to a body or torso portion of the jersey 100. As illustrated in FIGS. 1A and 1B, the seam 103 may, in embodiments, begin at a top edge of a shoulder portion of the jersey 100 and extend around the entirety of a circumference of the arm of the jersey 100 (and therefore of the arm of the wearer). It is to be expressly understood that the seam 103 may comprise a seam in the traditional sense (i.e. where the sleeve 101 and the body/torso portion of the jersey 100 are sewn together, i.e. held together with stitches), including but not limited to a plain seam, a French seam, a flat/abutted seam, or a lapped seam, and/or the seam 103 may comprise a portion where the sleeve 101 and the body/torso portion of the jersey 100 are held together by a means other than sewing/stitching (e.g. by heat-sealing).

The tail 104 of the motorcycling jersey 100 of the present invention, as previously discussed, is preferably long enough to prevent "untucking" of the jersey 100 from the waistband of a motorcycling pant or similar garment worn in conjunction with the motorcycling jersey 100. By way of non-limiting example, in embodiments the tail 104 of the motorcycling jersey 100 may be vertically coterminous with the lower edge of a buttocks portion of a motorcycling pant (i.e. where the motorcycling pant bifurcates into two distinct portions to accommodate the wearer's legs), but any length of the tail 104 sufficient to prevent untucking during wear may be provided and is within the scope of the present invention.

The ventilation system 105 of the motorcycling jersey 100 of the present invention, as previously discussed, comprises a portion of a mesh material or other similar material that permits a significant degree of air flow. Although in FIGS. 1A and 1B the ventilation system 105 is illustrated as being confined only to axillary portions of the jersey 100, it is to be expressly understood that mesh material or other similar material comprising a part of the ventilation system 105 may be provided on any desired portion of the jersey 100, including but not limited to part or all of the sleeve 101. In many embodiments, the axillary portion of the ventilation system 105 may "wrap around" to the posterior aspect of the jersey 100, as illustrated in FIG. 1B.

The collar 106 of the motorcycling jersey 100 of the present invention, as previously discussed, is illustrated in FIGS. 1A and 1B as a "V-neck" collar, but may also be a "crew-neck" collar or any other suitable type of collar. The collar 106 may, but need not, be provided with a separate cuff. Preferably, the collar 106 is configured to help provide the "snug fit" and/or compressive effect of the jersey 100, and may also be configured to minimize catching, dragging, or rubbing against the wearer's skin and/or the fabric of a garment worn under the jersey 100.

The vent 107 of the motorcycling jersey 100 of the present invention is disposed primarily along the posterior aspect of the sleeve 101, but at its proximal end the vent 107 is disposed partially within the body/torso portion of the jersey 100. As illustrated in FIGS. 1A and 1B, the proximal end of the vent 107 may combine and/or be provided in conjunction with the axillary ventilation system 105. As further illustrated, the vent 107 may run along substantially the entire length of the sleeve 101, from the seam 103 to the cuff 102, but it is to be expressly understood that the vent 107 may terminate short of the cuff 102 and that such embodiments are within the scope of the present invention. The vent 107 may, like the ventilation system 105, comprise a mesh material or another similar breathable material, and is provided for the purpose of increasing air flow through the jersey 100 and across the wearer's body.

Figure 2B:
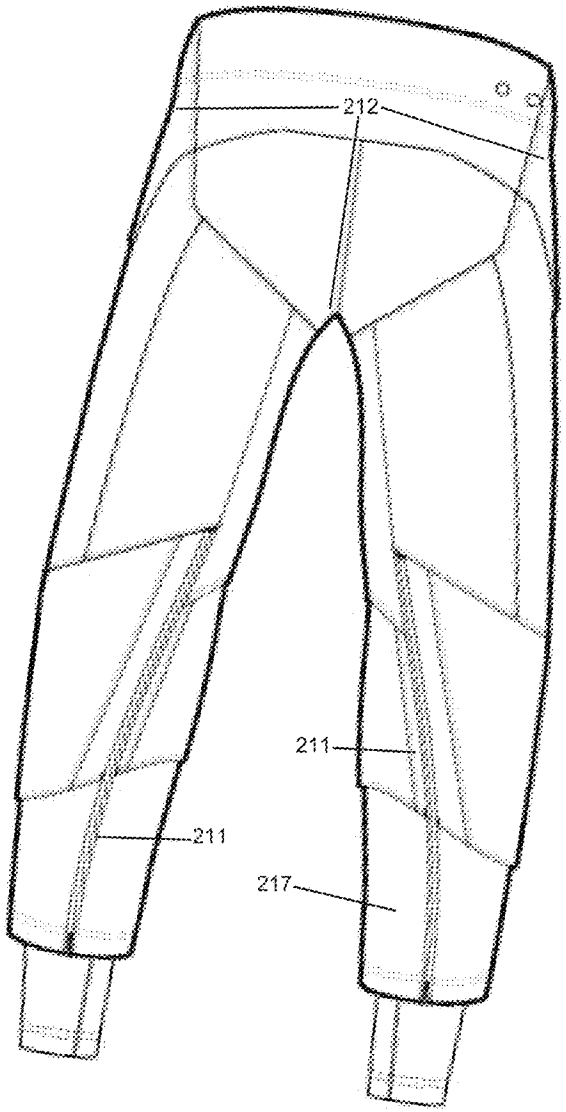
FIGS. 2A and 2B are views of an anterior portion and a posterior portion, respectively, of an outer layer of a motorcycling pant, according to embodiments of the present invention.
Figure 2A:
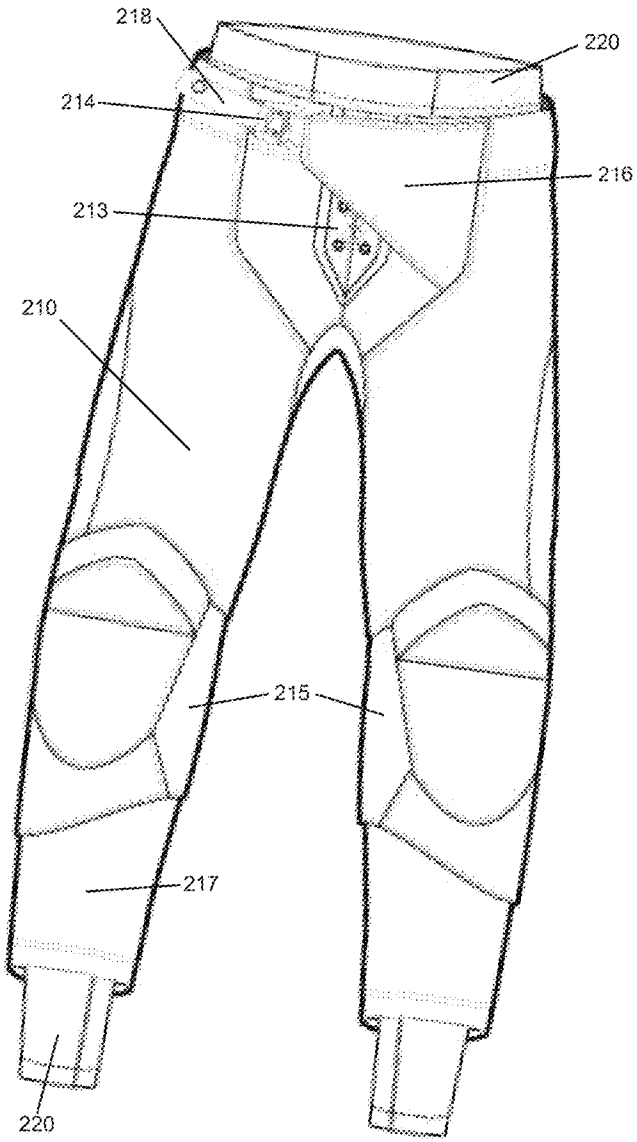

Referring now to FIGS. 2A and 2B, a motorcycling pant 200 according to embodiments of the present invention is illustrated. In this embodiment, the motorcycling pant 200 comprises an outer layer 210 and an inner layer 220, wherein the inner layer is a compressive layer; as illustrated, the inner layer 220 extends below a cuff of the outer layer 210. The outer layer 210 comprises a zipper 211, at least one stitch point 212 where the outer layer 210 is stitched or otherwise affixed to the inner layer 220, a lace system 213, a double-loop system 214 for securing the pant 200 around the waist of the wearer, a knee protection element 215, a flap 216 for covering and protecting the double-loop system 214, a cuff 217 at a distal end of the outer layer 210, and an integral belt/strap 218.

One principal advantage of the motorcycling pant 200 of the present invention is that the inner layer 220 comprises a compressive garment, i.e. a compression short or compression pant, which is integrated with and affixed to the protective outer layer 210. Compression shorts and pants are frequently encountered in sports other than motorcycling (e.g. baseball, basketball, football, etc.), and are often considered to enhance the athletic performance of the wearer in these and other applications. Without wishing to be bound by any particular theory, it is believed that compressive garments facilitate blood flow to the compressed region of the wearer's body and/or support joints in the compressed region of the wearer's body, both of which improve the wearer's performance during competition and/or improve the effectiveness of conditioning exercises and other training.

The compressive inner layer 220 of the motorcycling pant 200 may provide additional advantages and benefits to the wearer as well. By way of non-limiting example, the outer layer 210 of the motorcycling pant 200, in many embodiments, may comprise somewhat rough, heavy, or thick material(s) to protect the wearer against heat, impact, puncture, and other hazards; the compressive inner layer 220, being disposed between the wearer's body and the protective outer layer 210, may reduce the chafing and/or skin irritation of the wearer incurred as a result of wearing the motorcycling pant 200. This effect may be improved when, as shown in FIGS. 2A and 2B, a waist of the compressive inner layer 220 is adapted to be worn higher on the wearer's body than a waist of the protective outer layer 210. Such a "high-rise" design of the compressive inner layer 220 may also impart the additional benefit to the wearer of a compressive effect across a greater portion of the wearer's body, e.g. compression of the wearer's abdomen and/or groin.

The fact that the wearer's skin is not directly in contact with the material of the protective outer layer 210 improves the effectiveness of the outer layer 210 in protecting the wearer against heat, impact, vibration, etc. The outer layer 210 frequently comprises a material such as Kevlar, which is somewhat rough and may create significant friction when forced against another surface. This represents a flaw in the design of conventional motorcycling pants; in the event of a high-impact collision or other circumstance in which the outer layer protects the wearer against impact or puncture, the friction generated by the contact of the outer layer with the wearer's skin may irritate, injure, or even burn the wearer's skin. In the motorcycling pant 200 of the present invention, this drawback is addressed by the provision of the compressive inner layer 220, as any friction imparted by the outer layer 210 is absorbed by the inner layer 220 rather than the wearer's skin.

The compressive inner layer 220 is integrally affixed to the protective outer layer 210 by any suitable means, including but not limited to being sewn or stitched. In the embodiment of the motorcycling pant 200 illustrated in FIGS. 2A and 2B, the inner layer 220 is sewn and/or stitched within the outer layer 210 along stitch points 212 disposed on lateral surfaces of the legs of the pant 200 and in a crotch of the pant 200. Although it is highly preferable and advantageous for the outer layer 210 and inner layer 220 to be integrally affixed to each other, for the reasons described in greater detail below, it is to be expressly understood that in embodiments, there may be gaps, spaces, or voids between the outer layer 210 and the inner layer 220; in other words, it is not necessary that the inner layer 220 be sewn, stitched, or otherwise affixed to the outer layer 210 about an entire surface of the inner layer 220. By way of non-limiting example, a gap, space, or void may be provided allowing a wearer to tuck a motorcycling jersey, e.g. the jersey 100 depicted in FIGS. 1A and 1B, into the motorcycling pant 200 between the outer layer 210 and the inner layer 220.

In embodiments, the outer layer 210 is not entirely loose-fitting, but may have at least a portion that is "slim-fitting," i.e. conforms relatively closely to the wearer's body. In particular, it may be advantageous for the outer layer 210 to taper from a relatively loose-fitting waist to a snug fit in the cuff 217. Such a snug fit, especially in the lower portion of the legs, provides several advantages, including but not limited to increased comfort the wearer as a result of elimination of loose-hanging excess material, weight and cost savings as a result of decreased weight, etc. The most significant benefit, however, is that a snug fit of the outer layer 210 about the legs of the wearer keeps the outer layer 210 in place and mitigates or eliminates movement of the material of the outer layer 210 relative to the inner layer 220 and/or the user's leg (i.e. "shifting" or "sliding" of the material), which in turn keeps the knee braces typically worn by motocross racers and other motorcyclists over the motorcycling pant 200 in place.

The "slim-fitting" or "snug fit" portion of the leg of the outer layer 210 of the motorcycling pant 200 may extend upward along at least a portion of the length of the legs of the pant 200, in some embodiments at least as high as a knee of the rider. Such embodiments may be particularly desirable in motocross applications, as impact and vibration in motocross tend to result in a high rate of knee injury, which may be mitigated by providing a compressive effect (in addition to that provided by the compressive inner layer 220) to the knee and/or holding the knee joint of the wearer in place. This effect may improve the wearer's performance in addition to preventing or mitigating knee injury. Moreover, loose material of the outer layer 210 around a lower portion of the wearer's legs may catch on motorcycle components or other foreign objects when the wearer moves about on the motorcycle, which can result in degraded performance or injury; the snug/slim fit of the present invention eliminates this concern.

It may be generally preferable that a taper of the outer layer 210 may result in a slim fit or snug fit from the cuff 217 upward at least as far as the knee, and then a looser fit of the outer layer 210 about an upper portion of the wearer's legs and the wearer's groin and waist. Embodiments of this type preserve the benefits of the snug/slim fit around the wearer's ankles, calves, and/or knees as described above, but still permits the wearer full range of motion in the upper legs and waist.

The motorcycling pant 200 of the present invention addresses a common drawback of previous motorcycling pants: shifting of the pant relative to the wearer when the wearer adjusts position, e.g. from sitting to standing (or vice versa) or shifting forward or backward on the seat of the motorcycle. In previous designs, which are generally characterized by a loose fit in all portions of the pant, these and other types of movement by the wearer would typically cause the pant to sag down the wearer's legs, or conversely to ride up the wearer's legs. In the present invention, by contrast, shifting, sagging, or riding of the pant relative to the wearer is minimized due to the novel integration of the compressive outer layer 220 with the protective outer layer 210; if the inner layer 220 does not move, then neither does the outer layer 210.

In previous motorcycling pants, one common problem has been the difficulty of putting on knee braces (e.g. for motocross racing) over the motorcycling pant. Specifically, it has heretofore been difficult for a motocross competitor or other motorcyclist to equip his or her knee braces while maintaining a smooth pant surface underneath; the pant frequently bunches, stretches, or catches while the wearer is in the process of affixing the knee braces, which can result in rider discomfort and an ineffective interface between the knee brace and the motorcycling pant. The present inventors have addressed this drawback by providing a zipper 211 on the posterior surface of the outer layer 210; in the embodiment illustrated in FIGS. 2A and 2B, the zipper 211 runs from the bottom or near the bottom (e.g. from the cuff 217) of the outer layer 210 upward along the wearer's legs and terminates approximately at a midpoint of the wearer's hamstring, but it is to be expressly understood that the zipper may be provided in any configuration and/or orientation on the posterior surface of the outer layer 210.

The zipper 211 provides at least three significant advantages to the wearer. First, in the event of collision or other accident that results in injury to the wearer's lower leg, the wearer or a medical professional may gain access to the wearer's lower leg simply by unzipping the zipper 211, which is not possible in prior motorcycling pants (indeed, with conventional motorcycling pants, it is frequently necessary to cut the pant in case of leg injury, resulting in destruction of the pant). Second, the wearer may selectively adjust the "snugness" of the fit of the outer layer 210 by zipping or unzipping the zipper 211 to a desired extent, and by way of non-limiting example may remove the pant 200 more easily than prior art pants by simply unzipping the zipper 211 (thereby loosening the fit of the pant around the lower leg). Third, the zipper 211 greatly reduces the time and effort needed to put on knee braces; rather than struggling to ensure the pant is not bunched or caught and carefully affixing the knee brace in a time-consuming fashion, as previous motorcycling pants require, the present invention allows the wearer to unzip the zipper 211, put on the knee brace with little regard for bunching or wrinkling of the outer layer 210 underneath, and then zip the zipper 211 to ensure the snug fit of the outer layer 210 under the knee brace.

Motorcycling pants 200 of the present invention may also differ from previously known pants by replacing the conventional closure mechanisms (a zipper fly and a plastic clip belt) with a lace system 213 and double-loop system 214. The double-loop system 214 comprises a strap and two metal loops, similar to closure/fastener devices provided on many current motorcycle helmets. The combination of the lace system 213 and double-loop system 214 improves the ease with which the wearer may don and/or remove the motorcycling pant 200 and the comfort the wearer experiences while wearing the motorcycling pant 200.

The provision of two separate layers—the protective outer layer 210 and the compressive inner layer 220—as an integrated motorcycling pant 200 allows the outer layer 210 to be made of thinner, lighter, and/or more breathable materials than conventional motorcycling pants that may provide only a single layer of protection. By way of non-limiting example, the outer layer 210 and/or the inner layer 220 may comprise at least one material selected from the group consisting of nylon, modacrylic, olefin fiber, acrylic fiber, polyester, rayon (including but not limited to modal and Lyocell), spandex, vinalon, aramids (including but not limited to Nomex, Kevlar, and Twaron), Dyneema, polybenzimidazole fiber (PBI), and wool. It may be particularly desirable, in certain embodiments, for the outer layer 210 to be made primarily of a durable, flexible material that is highly resistant to heat, impact, and puncture (e.g. Kevlar) and the inner layer 220 to be made primarily of an elastic material useful for providing a compressive effect to the wearer's body (e.g. spandex).

The zipper 211, and/or another zipper or closure mechanism that may be provided in conjunction with the outer layer 210, may, in some embodiments, enable the wearer to add or remove portions of the outer layer 210. By way of non-limiting example, the zipper 211 may enable the wearer to "zip off" the lower leg portions of the outer layer 210 entirely, retaining the upper leg portions of the outer layer 210 as a shorts-type garment with the inner layer 220 extending downwardly beyond the outer layer 210. It is also to be expressly understood that the zipper may be oriented and/or configured to open and/or close in any desired direction; by way of non-limiting example, the zipper 211 may zip up to open and down to close, or down to open and up to close, or left to open and right to close, or right to open and left to close, and so on.

The compressive inner layer 220 may be sewn, stitched, or otherwise affixed to the protective outer layer 210 at one or more stitch point(s) 212. As illustrated in FIGS. 2A and 2B, the stitch point(s) 212 may, in embodiments, be disposed on lateral surfaces of the legs of the pant 200 and in a crotch of the pant 200. It is to be expressly understood that the stitch point(s) 212 may comprise a seam in the traditional sense (i.e. where the outer layer 210 and inner layer 220 are sewn together, i.e. held together with stitches), including but not limited to a plain seam, a French seam, a flat/abutted seam, or a lapped seam, and/or the stitch point(s) 212 may comprise a portion where the outer layer 210 and inner layer 220 are held together by a means other than sewing/stitching (e.g. by heat-sealing).

The lace system 213 of the motorcycling pant 200 of the present invention allows the wearer to selectively open and/or close a fly or crotch portion of the motorcycling pant 200. It is to be expressly understood that embodiments in which the lace system 213 is complemented with or substituted by other known closure mechanisms, e.g. zipper, buttons, snaps, hook-and-loop fastener, etc., are contemplated as being within the scope of the present invention.

The double-loop system 214 of the motorcycling pant 200 of the present invention allows the wearer to selectively tighten and/or loosen a waist of the motorcycling pant 200 using the integral belt/strap 218. The double-loop system 214 may also secure the protection flap 216 covering the lace system 213, as described in greater detail below.

Motorcycling pants 200 may optionally comprise a distinct knee protection element 215, illustrated in FIGS. 2A and 2B as being disposed on an inner knee portion of the outer layer 210. Because the knees of motorcyclists, and of motocross riders in particular, are particularly prone to impact injuries, and because the knee portion of the motorcycling pant 200 tends to wear out quickly, the optional knee protection element 215 may provide both added protection for the wearer's knee and increased durability and structural integrity of the motorcycling pant 200. To aid in this, the knee protection element 215 is preferably constructed of one or more strong, durable, and relatively rigid materials that are highly resistant to impact and puncture, e.g. leather.

The protection flap 216 covers the lace system 213, preventing the laces from being damaged, severed, loosened, etc. by flying debris while the wearer is motorcycling. The double-loop system 214 and integral belt/strap 218 may, in some embodiments, serve to hold the protection flap 216 in place.

The cuff 217 may, but need not, be made of a different material than the rest of the outer layer 210. By way of non-limiting example, the cuff 217 of the outer layer 210 may be made of the same or a similar material as the compressive inner layer 220. In some embodiments, the cuff 217 may comprise one or more stitch point(s) 212 where the outer layer 210 and the inner layer 220 are affixed to each other, and in some of these embodiments the zipper 211 may serve to open and/or close both layers 210, 220.

The integral belt/strap 218 is used in conjunction with the double-loop system 214 to allow the wearer to selectively tighten and/or loosen a waist of the motorcycling pant 200. In some embodiments, the integral belt/strap 218 may cover and/or be disposed atop the protection flap 216, such that tightening the integral belt/strap 218 and securing it via the double-loop system 214 may simultaneously hold the protection flap 216 in position over the lace system 213.

Figures 3A, 3B:
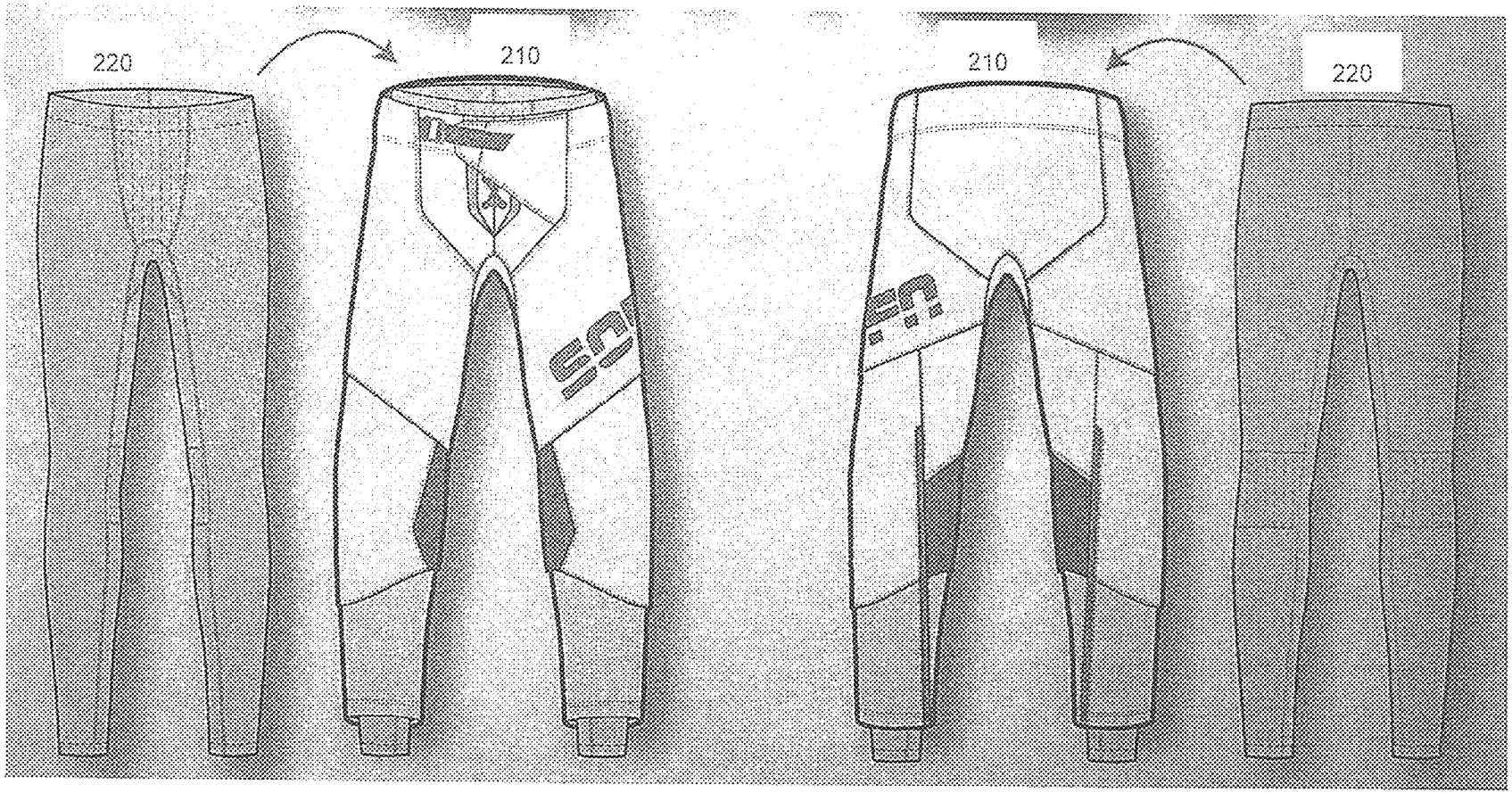
FIGS. 3A and 3B are views of an anterior portion and a posterior portion, respectively, of an inner layer of a motorcycling pant, according to embodiments of the present invention.

Referring now to FIGS. 3A and 3B, the motorcycling pant 200 of the present invention is shown in exploded view, wherein the inner layer 220 has been separated from the outer layer 210. As will be appreciated, the motorcycling pant 200 may be manufactured by providing separate inner layer 220 and outer layer 210 and then stitching, sewing, heat-sealing, or by another means affixing the inner layer 220 to an interior of the outer layer 210. Such methods of manufacture are within the scope of the present invention.

The present disclosure, in various aspects, embodiments, and/or configurations, includes components, methods, processes, systems, and/or apparatus substantially as depicted and described herein, including various aspects, embodiments, configurations embodiments, sub-combinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and/or reducing cost of implementation.

The foregoing discussion has been presented for purposes of illustration and description. The foregoing is not intended to limit the disclosure to the form or forms disclosed herein. In the foregoing Detailed Description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The invention claimed is:

1. A motorcycling pant, comprising:

an outer layer, comprising a leg portion, the leg portion comprising a proximal end and a distal end, wherein the leg portion of the outer layer further comprises an inner surface and an outer surface; and an inner layer, comprising a compressive garment, wherein the compressive garment of the inner layer is integrally affixed to the inner surface of the proximal end of the outer layer and unaffixed to the distal end of the leg portion of the outer layer;

a zipper, wherein the zipper comprises a proximal end and a distal end and is disposed along a length of the leg portion of the outer layer, and wherein the distal end of the zipper is coterminous with the distal end of the leg portion of the outer layer permitting direct access to the inner layer; and a lacing fly closure and a protection flap wherein the protection flap covers the lacing fly closure.

2. The motorcycling pant of claim 1, wherein the compressive garment of the inner layer is integrally affixed to the inner surface of the outer layer by sewing or stitching.

3. The motorcycling pant of claim 1, wherein the compressive garment of the inner layer is integrally affixed to the inner surface of the outer layer by heat-sealing.

4. The motorcycling pant of claim 1, wherein the zipper is oriented substantially vertically along the length of the leg portion of the outer layer.

5. The motorcycling pant of claim 4, wherein the zipper has a lower terminus coincident with a cuff of the leg portion of the outer layer and an upper terminus located approximately midway between a knee of the outer layer and a waist of the outer layer.

6. The motorcycling pant of claim 1, wherein the zipper is oriented substantially horizontally across a width of the leg portion of the outer layer.

7. The motorcycling pant of claim 1, further comprising a lacing fly closure.

8. The motorcycling pant of claim 1, further comprising a knee protection element disposed on a lateral knee portion of the outer layer, and a double-loop tightening device, and wherein the protection flap is integrally connected to the double-loop tightening device, and wherein the double-loop tightening device holds the protection flap in place.

9. A method for manufacturing a motorcycling pant, comprising:

providing a compressive garment comprising a proximal and a distal end;

disposing the compressive garment within a motorcycling pant outer layer comprising a proximal end and a distal end;

integrally affixing the proximal end of the compressive garment to the proximal end of the motorcycling pant outer layer;

disposing a zipper on the distal end of the outer layer of the motorcycle pant, wherein the zipper permits access to the inner layer; and disposing a lacing fly closure and a protection flap, wherein the protection flap covers the lacing fly closure.

10. The method of claim 9, wherein the integrally affixing step comprises sewing or stitching the compressive garment to the inner surface of the outer layer.

* * * * *